US005478296A

United States Patent [19]

Lee

[11] Patent Number: 5,478,296

[45] Date of Patent: Dec. 26, 1995

[54] HORIZONTAL EXERCISER BIKE

[76] Inventor: Long-Hwei Lee, 1 Lane 1561, Chung San Road, Sec. 1, Ta Chia Town, Taichung Hsien, Taiwan

[21] Appl. No.: 449,344

[22] Filed: May 24, 1995

[51] Int. Cl.[6] ..... A63B 21/00

[52] U.S. Cl. ..... 482/73; 482/131

[58] Field of Search ..... 482/57, 62, 72, 482/111, 112, 58, 51, 73, 142, 131

[56] References Cited

U.S. PATENT DOCUMENTS

| | | | |
|---|---|---|---|
| 4,684,126 | 8/1987 | Dalebowt et al. | 482/72 |
| 5,242,179 | 9/1993 | Beddome et al. | 482/62 |
| 5,356,356 | 10/1994 | Hildebrandt et al. | 482/62 |
| 5,356,357 | 10/1994 | Wang et al. | 482/72 |
| 5,387,169 | 2/1995 | Wang | 482/73 |
| 5,423,731 | 6/1995 | Chen | 482/72 |

*Primary Examiner*—Stephen R. Crow
*Attorney, Agent, or Firm*—Beveridge, DeGrandi, Weilacher & Young

[57] ABSTRACT

Disclosed is a horizontal exerciser bike which mainly consists of a main support, a counter, a pair of linkages, and other related components. The main support is so designed that it horizontally extends along a longitudinal axis thereof and therefore has a low center of gravity. The linkages are separately disposed at two sides of the main support and each comprises a foot pedal post pivotally connected to a front end of the main support, an n-shaped bracket fixedly attached to a lower portion of the foot pedal post, a link pivotally connected at a front end to the n-shaped bracket and at a rear end to an inverted T-shaped coupler pivotally attached to one side of the main support, a cylinder pivotally connected at a front extension end to the inverted T-shaped coupler and fixedly connected at a rear end to a fixed pin disposed near a rear end of the main support, and a grip post adjustably connected to a middle portion of the inverted T-shaped coupler. A seat is provided above the main support at a middle portion thereof for a user to stably sit thereon while grips the grip posts and pedals the foot pedal posts alternately to do physical exercise safely.

7 Claims, 5 Drawing Sheets

HORIZONTAL EXERCISER BIKE

BACKGROUND OF THE INVENTION

The present invention relates to a horizontal exerciser bike which has a substantially horizontally extended main support and therefore has a flow center of gravity, and more particularly to a horizontal exerciser bike which is provided with a seat for a user to sit thereon to do foot and hand exercises at the same time in a more comfortable manner.

FIG. 5 shows a conventional exerciser bike which has an uprising structure and therefore a high center of gravity. The exerciser bike has a substantially inverted T-shaped main support 10*a*, a pair of handles 20*a* fixedly connected to an upper portion of the main support 10*a*, a pair of pedals 30*a* disposed at a lower end of the main support 10*a*, and two cylinders 40*a* separately connected between the pedals 30*a* and the main support 10*a*. A user may step on the pedals 30*a* with two hands gripping the pair of handles 20*a* and then pedals with two feet alternately. A counter 50*a* is disposed on a top end of the main support 10*a* to count the numbers of movement of two feet on their pedals 30*a*.

Following drawbacks exist in the above conventional exerciser bike and would require improvements:

1. The exerciser bike has an uprising structure and a high center of gravity and tends to unstably sway when it is in use. Athletic impairments are easily caused, accordingly.
2. The conventional exerciser bike has limited effect and lower efficiency for the purpose of exercise because it provides only foot exercise without hand exercise or body exercise.
3. The conventional uprising exerciser bike is not provided with a seat and the user has to always use two feet to support his/her weight while pedaling. The user's legs tend to become tired and the exercise can not be continued for a proper period of time to achieve good fitness effect.

It is therefore tried by the inventor to develop a horizontal exerciser bike which has firm, reliable, and durable structure and is convenient in operation.

SUMMARY OF THE INVENTION

A primary object of the present invention is to provide a horizontal exerciser bike of which a main support extends horizontally and thereby has a low center of gravity, making the exerciser bike more stable and reliable without swaying even when it is pedaled at high speed.

Another object of the present invention is to provide a horizontal exerciser bike in which a seat is furnished to allow the user to do exercise in a more comfortable manner and thereby enhances the performance of exercise.

A further object of the present invention is to provide a horizontal exerciser bike in which a pair of linkages are provided at two sides of the main support, causing two hand grips to move back and forth alternately along with two pedals and thereby providing hand and foot exercises at the same time.

A still further object of the present invention is to provide a horizontal exerciser bike in which the seat, pedals, and hand grips all are adjustable so that the exerciser bike can meet the requirements and preferences of different users.

The detailed structure and the technical means used to achieve the above and other objects of the present invention, as well as the characteristics and effects thereof will become apparent when referring to the following detailed description of the preferred embodiment and the accompanying drawings.

DETAILED DESCRIPTION OF THE PREFERRED EMBODIMENTS

Figure 1:
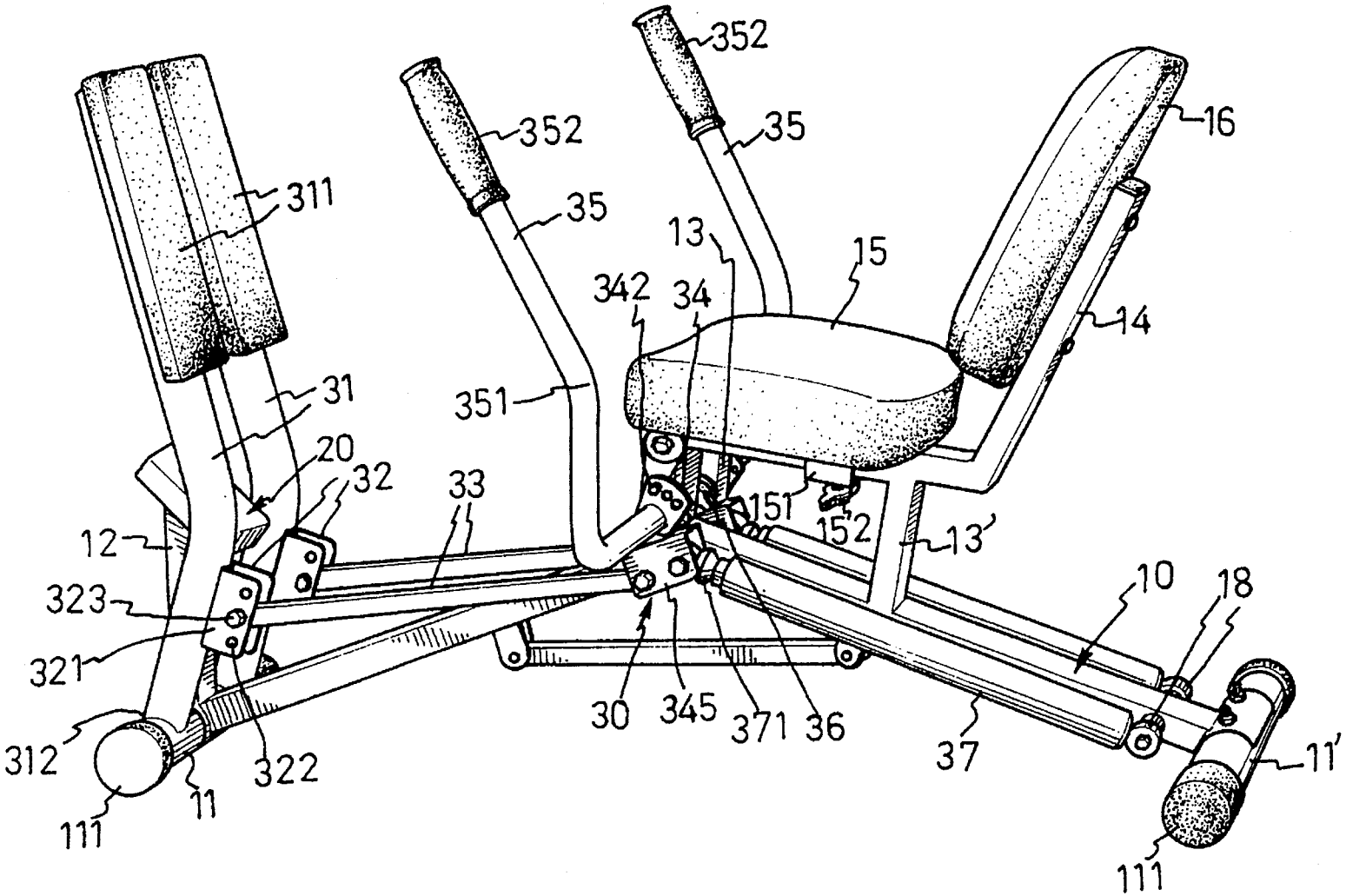
FIG. 1 is a three-dimensional perspective of a horizontal exerciser bike according to the present invention.

Please refer to FIG. 1 in which a perspective view of the present invention is shown. The present invention is a horizontal exerciser bike comprises a main support 10, a counter 20, a pair of linkages 30, and other related parts. As it can be seen from FIG. 1, the exerciser bike of the present invention is so designed that it has a horizontally and longitudinally extended structure which has a low center of gravity and therefore allows the exerciser bike to be more stably positioned when it is in use.

The main support 10 extends horizontally along a longitudinal axis thereof and looks like a letter "A" when viewing sidewardly that permits the main body 10 to have a low center of gravity. A front and a rear leg members 11, 11' are transversely attached to a front and a rear ends of the main body 10, respectively. Non-skid covers 111, 111' are preferably put over two outer ends of the front and the rear leg members 11, 11', respectively, to further enhance the reliable and stable position of the whole main support 10.

The counter 20 is disposed on a long post 12 connected to and upward extending from an upper center of the front leg member 11. Two pins 18 separately extend and project from each lateral side of the main support 10 at positions a little in front of the rear leg member 11'. The main support 10 has a middle uprisen waist portion. A front and a rear seat legs 13, 13' extend upward from a rear part of the waist portion of the main support 10 to connect an L-shaped seat support 14 above the main support 10. At a point at where the front seat leg 13 and the seat support 14 join each other a through hole 17 is transversely formed. A seat cushion 15 and a back cushion 16 are attached to a front or horizontal part and a rear or vertical part of the seat support 14, respectively. A sleeve 151 connected to a lower bottom surface of the cushion 15 is disposed around the front part of the L-shaped seat support 14 in advance and is allowed to move back and forth freely along the front part of the L-shaped seat support 14. A first adjusting screw 152 is attached to an underside of the sleeve 151. The seat cushion 15 can be adjusted to a desired position on the front part of the seat support 14 by loosening and then tightening the first adjusting screw 152 again.

The pair of linkages 30 are separately arranged at each lateral side of the main support 10 and each mainly comprises from a front end toward a rear end a foot pedal post 31, an n-shaped bracket 32, a link 33, an inverted T-shaped coupler 34, a grip post 35, a second adjusting screw 36, and a cylinder 37, as well as some other related components.

Figure 2:
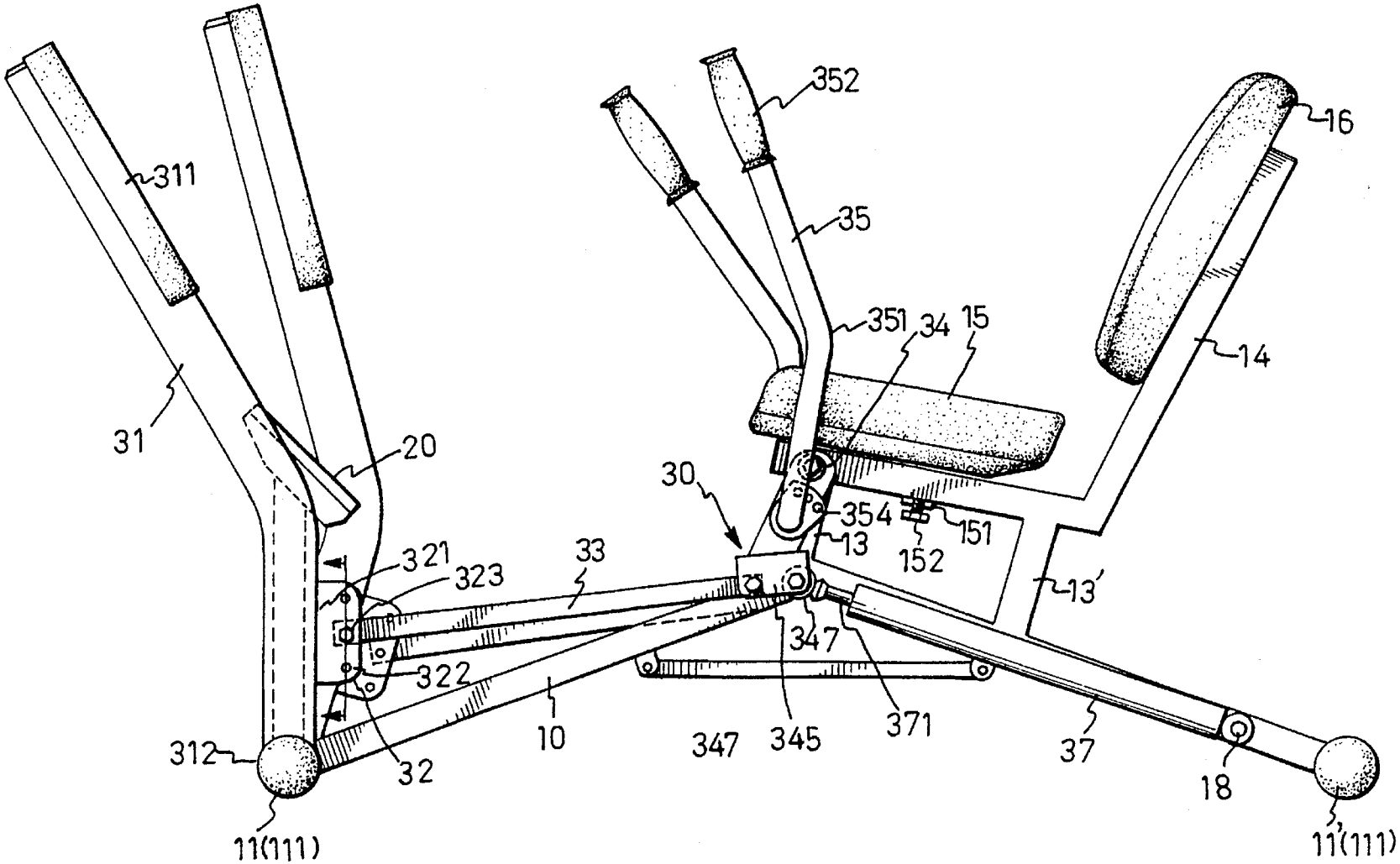
FIG. 2 is a side view of the exerciser bike of FIG. 1, showing the operation thereof.

The foot pedal post 31 is pivotally connected at a lower end 312 to the front leg member 11 near an outer end thereof and extends upward therefrom. The foot pedal post 31 has a slightly bent middle section such that an upper and a lower sections thereof extend forward relative to the main support 10. A foot pedal 311 is fixedly attached to the upper section of the post 31 to face the back cushion 16 and the n-shaped bracket 32 is fixedly connected to the lower section of the post 31 at a predetermined position thereof. Both foot pedal posts 31 can be pushed at the pedals 311 so that they pivotally move back and forth about the front leg member 11 as shown in FIG. 2.

Figure 3:
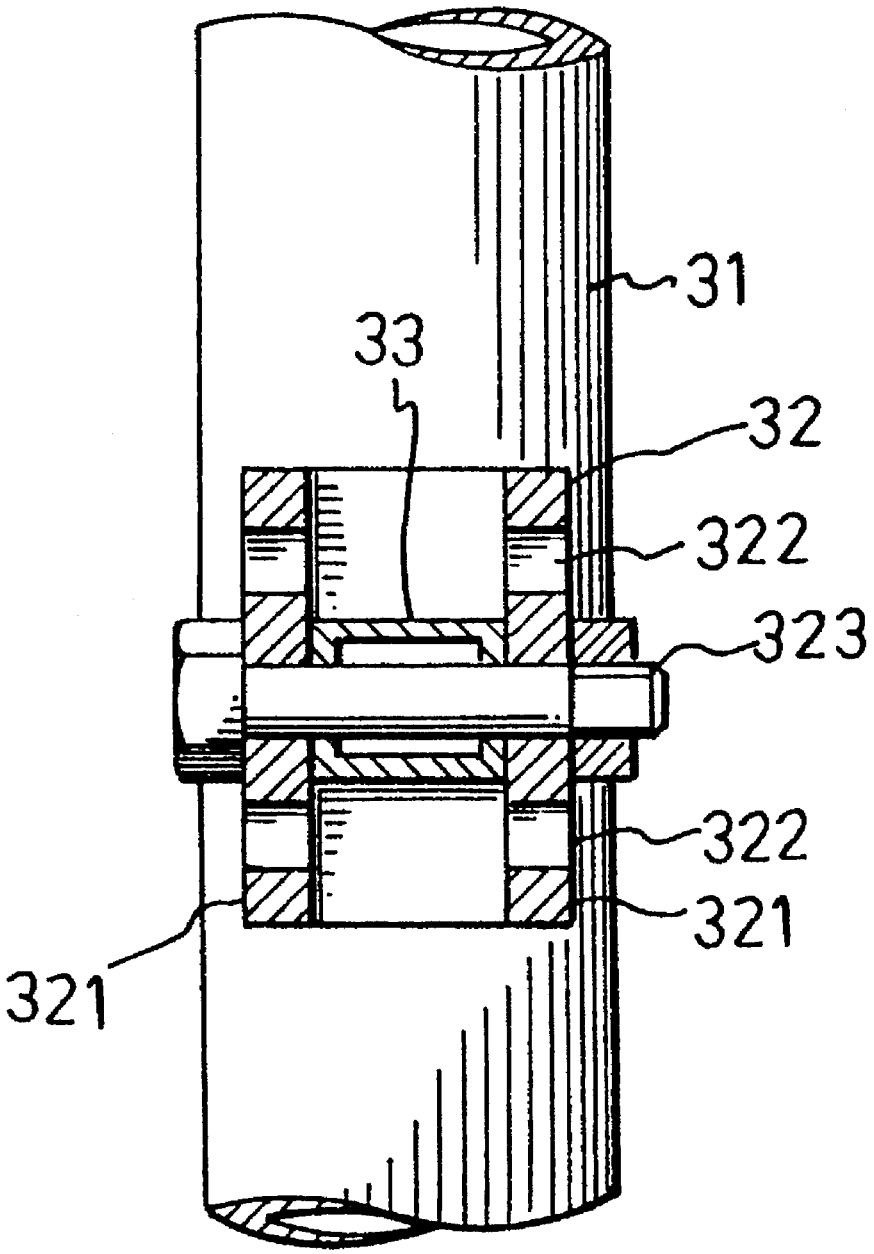
FIG. 3 is a fragmentary, enlarged view with a part thereof being cut away to more clearly show the manner in which the n-shaped bracket is assembled with the link of the present invention.

Please refer to FIG. 3. The n-shaped bracket 32 is provided at its two side walls 321 with several pairs corresponding through holes 322. A first threaded bolt 323 may be threaded through any pair of the corresponding holes 322 and a front end of the link 33 to pivotally connect the link 33 to the bracket 32.

Figure 4:
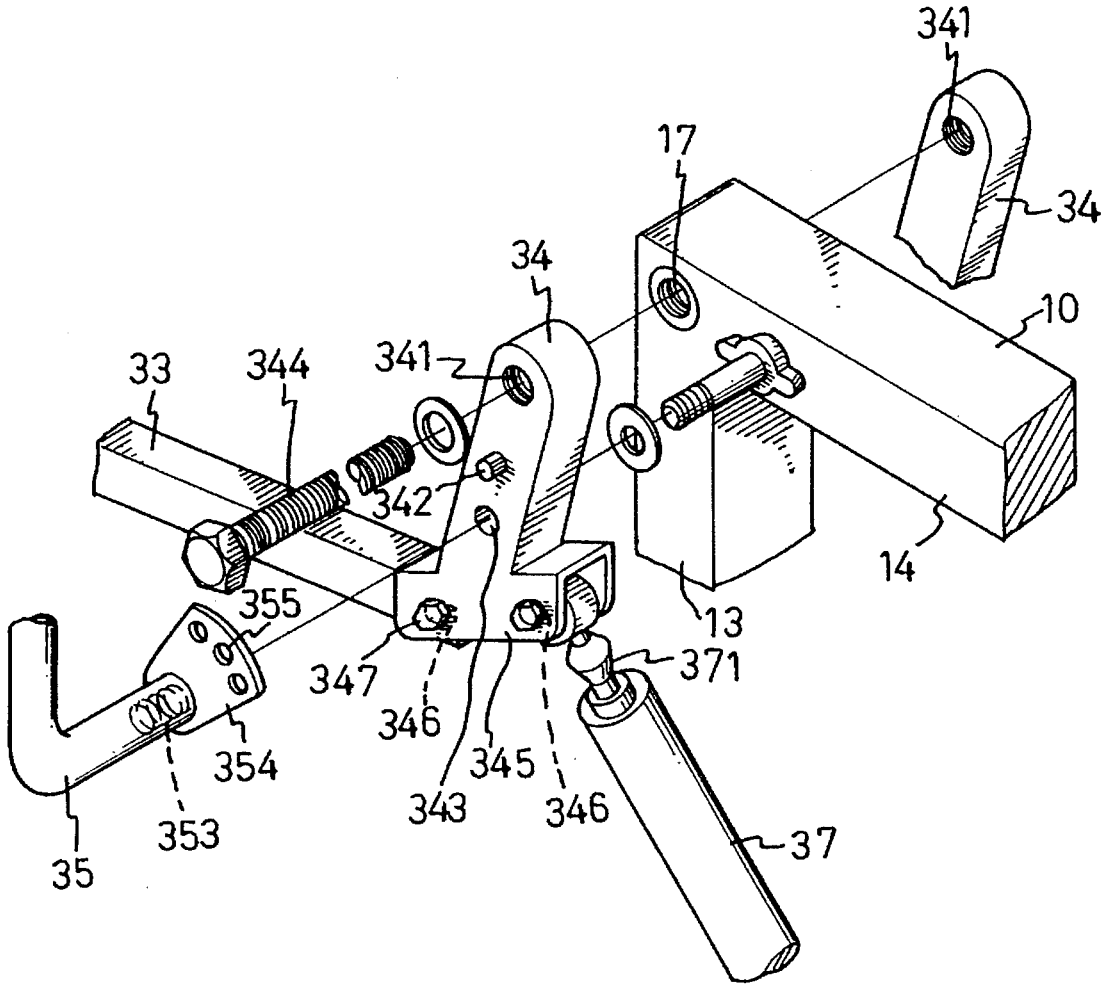
FIG. 4 is a fragmentary, exploded perspective showing the manner in which the linkage is assembled with the main support of the present invention.
Figure 5:
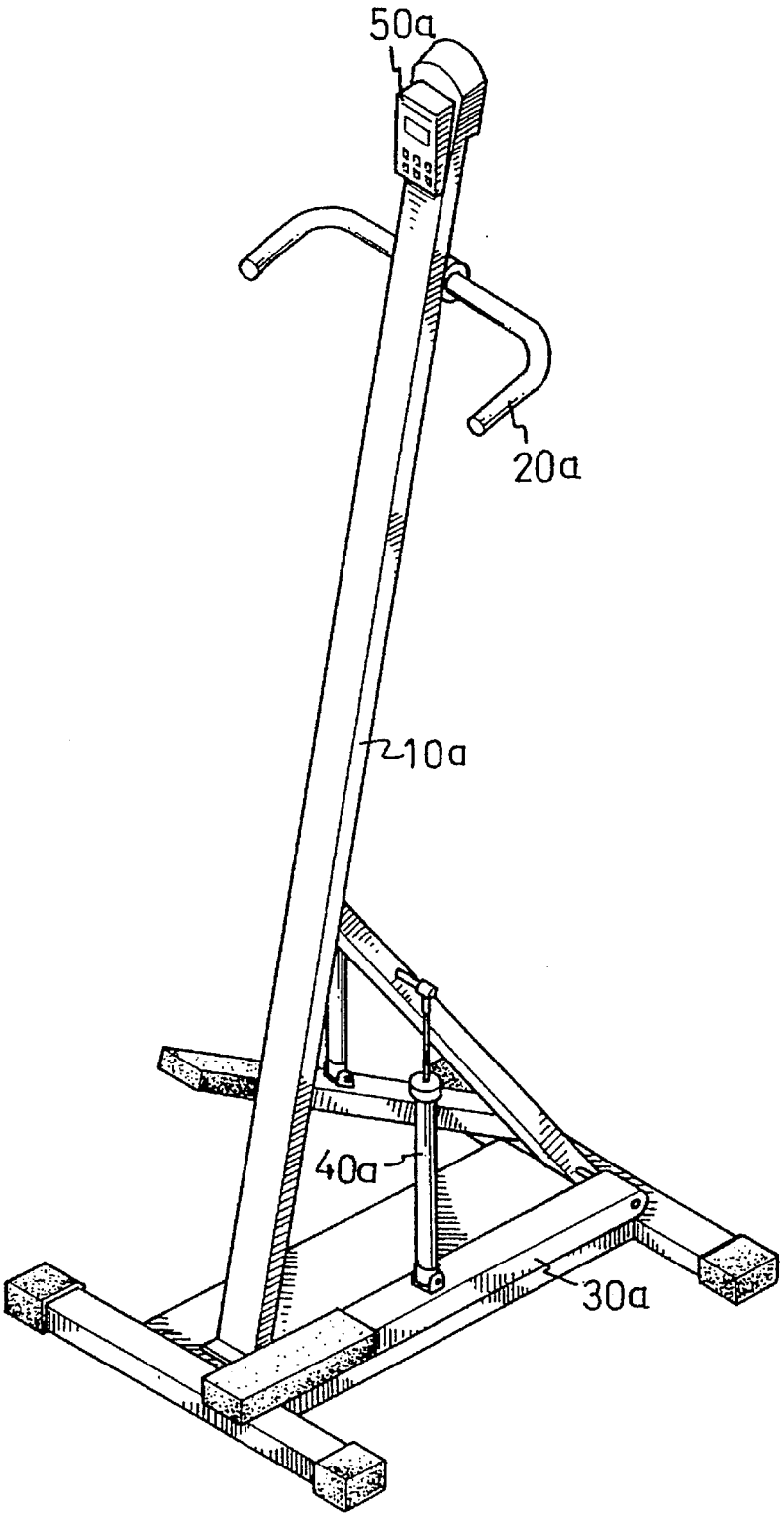
FIG. 5 (PRIOR ART)
FIG. 5 is a three-dimensional perspective showing a conventional uprising exerciser bike.

Please now refer to FIG. 4. The inverted T-shaped coupler 34 is pivotally attached to an outer side of the main support 10 with its vertical section pointing upward and slightly inclining backward toward the rear end of the main support 10. A threaded hole 341, a locating pin 342, and a through hole 343 are sequentially formed on the vertical section of the coupler 34 from a top end thereof toward a lower portion separately at predetermined positions. A second threaded bolt 344 is threaded through the threaded hole 341 and the through hole 17 formed on the front seat leg 13, so that the inverted T-shaped coupler 34 is pivotally movable about the second bolt 344 relative to the main support 10.

A lower horizontal section 345 of the inverted T-shaped coupler 34 has a n-shaped cross section and is provided at a front and a rear parts thereof relative to the vertical section each with a transverse hole 346 through which a third threaded bolt 347 is extended through. A rear end of the link 33 is pivotally connected to the front part of the horizontal section 345 of the inverted T-shaped coupler 34 by means of the third threaded bolt 347. The cylinder 37 is pivotally connected at a front extension end 371 to the rear part of the horizontal section 345 by means of another third threaded bolt 347 and at a rear end to the pin 18 disposed a little in front or the rear leg member 11'. With these arrangements, when the foot pedal posts 31 are alternately pedaled at the foot pedals 311 and thereby pivotally moved back and forth about the front leg member 11, the links 33 connected thereto via the n-shaped brackets 32 are pulled to cause the inverted T-shaped couplers 34 connected to the other end of the links 33 via the n-shaped lower sections 345 to sway back and forth about the second threaded bolts 344. The swaying couplers 34 in turn pull the cylinders 37 via the front extension end 371 to shift back and forth, generating a resistance to the legs of an exerciser bike user.

The grip posts 35 are also L-shaped and are correspondingly disposed at two sides of the main support 10 with their respective lower horizontal sections laterally and transversely extending inward toward the inverted T-shaped couplers 34. The lower horizontal section of the grip post 35 has an internally threaded end 353 above which a generally scalloped plate 354 having several locating holes 355 thereon is perpendicularly attached and extends upward therefrom. By means of the second adjusting screw 36 threading through the inverted T-shaped coupler 34 via the through hole 343 and then into the threaded end 353 of the grip post 35, the grip post 35 can be firmly attached to the coupler 34 with one of the holes 355 on the scalloped plate 354 engaging with the locating pin 342 on the coupler 34. The engagement of the locating pin 342 with a different locating hole 355 by means of loosening and then tightening again the second adjusting screw 36 allows the grip post 35 to be fixed to the main support 10 at a certain desired angle relative to the seat support 14 and thereby meets the requirement of different users. The grip posts 35 each has an upward extended upper section which has a backward bent middle portion 351 and has a non-skid cover 352 put over a top end thereof.

With the above arrangements, the exerciser bike according to the present invention has the advantages of, for example, having an originative structure which is characterized by the provision of a seat, a low center of gravity, a reliable and stable structure without the risk of swinging or skidding even under quick and fierce operation; having adjustable components which allow the invention to be used by users of different heights, weights, habits, preferences, etc.; and indirectly providing the users with hand exercise.

It should be noted the above embodiment is only used for illustration and is not intended to limit the scope of the present invention. Many modifications of the embodiment can be made without departing from the spirit of the present invention.

What is claimed is:

1. A horizontal exerciser bike comprising a main support, a counter, and a pair of linkages;

said main support extending horizontally along a longitudinal axis thereof and therefore having a low center of gravity, said main support further having a front and a rear leg members transversely attached to a front and a rear ends thereof, respectively, and a seat fixedly supported on a middle portion thereof;

said counter disposed at said front end of said main support;

said pair of linkages each comprising a foot pedal post, an n-shaped bracket, a link, an inverted T-shaped coupler, a grip post, a second adjusting screw, and a cylinder;

said foot pedal post pivotally connected at a lower end to said front leg member near an outer end thereof and extending upwardly therefrom, and having a foot pedal fixedly attached to an upper section thereof to face backwards toward said seat on said main support;

said n-shaped bracket fixedly connected to a lower section of said foot pedal post at a predetermined position thereof;

said link pivotally connected at a front end to said n-shaped bracket and at a rear end to said inverted T-shaped coupler;

said inverted T-shaped coupler having a vertical upper section which is pivotally connected to an outer side of said main support near a middle waist portion thereof and a horizontal lower section to a front end of which said rear end of said link is pivotally connected and to a rear end of said horizontal lower section of said inverted T-shaped coupler a front extension end of said cylinder is pivotally connected;

said cylinder connected at a rear end to a pin fixedly disposed near said rear end of said main support before said rear leg member such that when said foot pedal post is pedalled said linkage connected thereto via said n-shaped bracket is pulled forward against a resistance from said cylinder; and said grip post being L-shaped and fixedly connected at a horizontal lower section to one side of said main support near a middle portion of said inverted T-shaped coupler.

2. A horizontal exerciser bike as claimed in claim 1, wherein said main support looks like a letter "A" when viewed sideways and has non-skid covers put over each outer end of said front and said rear leg members thereof, said counter disposed on a long post connected to and upwardly extending from an upper center of said front leg member of said main support, and said seat comprising an L-shaped seat support fixedly supported on a front seat leg and a rear seat leg upward extending from said main support, a seat cushion fixedly attached to a horizontal front section of said seat support, and a back cushion fixedly attached to a rear vertical section of said seat support.

3. A horizontal exerciser bike as claimed in claim 1, wherein said foot pedal posts each have slightly bent middle section such that an upper and a lower section thereof extend forward relative to said main support, and said n-shaped brackets each provided at two side walls thereof with several pairs of corresponding through holes through any pair of which a threaded bolt is threaded to pivotally connect said front end of said link such that said link is adjustably and pivotally connected to said n-shaped bracket at different heights.

4. A horizontal exerciser bike as claimed in claim 1, wherein said inverted T-shaped couplers each has two holes formed on said front, end and said rear end of said horizontal lower section thereof, through said two holes threaded bolts are threaded to respectively pivotally connect said link and said cylinder thereto.

5. A horizontal exerciser bike as claimed in claim 2, wherein said main support has a through hole formed at a point where said front seat leg and said seat support join with each other, said inverted T-shaped coupler having a threaded hole formed at a top end of said vertical upper section thereof, and through said through hole of said front seat leg and said threaded hole of said inverted T-shaped coupler a threaded bolt threaded such that said inverted T-shaped coupler is firmly and pivotally attached to one side of said main support.

6. A horizontal exerciser bike as claimed in claim 1, wherein said grip posts each has an upwardly extended upper section having a backward bent middle portion and being covered with a non-skid cover at a top end thereof, and said horizontal lower section of each said grip post having an internally threaded end above which a generally scalloped plate having several locating holes thereon is perpendicularly attached and extends upwardly therefrom, said grip post firmly attached to said inverted T-shaped coupler by threading said second adjusting screw through said inverted T-shaped coupler via a through hole formed at a lower portion of said vertical upper section thereof and then into said threaded end of said grip post with one of said locating holes on said scalloped plate engaging with a locating pin provided on said vertical upper section of said inverted T-shaped coupler between said top threaded hole and said lower through hole, thereby an engagement of said locating pin with one of said locating holes of said scalloped plate by means of loosening and then tightening again said second adjusting screw allows said grip post to be fixed to one side of said main support at a desired angle relative to said seat support to satisfy different users.

7. A horizontal exerciser bike as claimed in claim 2, wherein a sleeve is connected to a lower bottom surface said seat cushion and disposed around said horizontal front section of said L-shaped seat support so as to allow said seat cushion to move back and forth along said seat support by means of loosening a first adjusting screw below said sleeve.

* * * * *